US005538363A

United States Patent [19]

Eastwood

[11] Patent Number: 5,538,363

[45] Date of Patent: Jul. 23, 1996

[54] RETAINING WALL STRUCTURE

[76] Inventor: Scott A. Eastwood, 259 Longfellow Ave., North Babylon, N.Y. 11703

[21] Appl. No.: 395,798

[22] Filed: Feb. 28, 1995

[51] Int. Cl.[6] ..... E02D 29/02

[52] U.S. Cl. ..... 405/262; 405/284; 405/285; 256/19; 256/24

[58] Field of Search ..... 52/71; 256/19, 256/24, 26, 65, 73; 405/284, 285, 286, 262, 259.1, 258

[56] References Cited

U.S. PATENT DOCUMENTS

| | | | |
|---|---|---|---|
| 3,512,759 | 5/1970 | Resler | 256/19 |
| 3,537,687 | 11/1970 | Adelman | 256/24 |
| 3,604,685 | 9/1971 | Pokryfki | 256/25 |
| 4,725,170 | 2/1988 | Davis | 405/286 |
| 5,184,808 | 2/1993 | Vesper | 256/31 |
| 5,368,416 | 11/1994 | Cataldo | 405/284 X |
| 5,456,554 | 10/1995 | Barrett et al. | 405/284 |

*Primary Examiner*—Michael Powell Buiz
*Assistant Examiner*—James A. Lisehora

[57] ABSTRACT

A retaining wall structure comprising a base plate having an outboard surface, an inboard surface, a top edge, a bottom edge, and a pair of opposed side edges, a top slot formed along the top edge, a side slot formed along each side edge, a first set of symmetrically aligned eyelets extended outwards from the inboard surface near one side edge, and a second set of symmetrically aligned eyelets extended outwards from the inboard surface near the other side edge; a pair of support braces with each support brace having a central portion interconnected between a pair of eyelets; and four spikes with one of the spikes slidably disposed within the eyelets of the first set and one of the eyelets of one of the support braces, another spike slidably disposed within the second set of eyelets of the base plate and one of the eyelets of the other support brace, and the remaining spikes each slidably disposed within one of the remaining eyelets of each support brace and with the spikes securable in a recipient surface for holding the base plate in an upstanding configuration.

7 Claims, 4 Drawing Sheets

PRIOR ART

RETAINING WALL STRUCTURE

BACKGROUND OF THE INVENTION

1. Field of the Invention

The present invention relates to a retaining wall structure and more particularly pertains to blocking a view or supporting weight with a retaining wall structure.

2. Description of the Prior Art

The use of walls is known in the prior art. More specifically, walls heretofore devised and utilized for the purpose of providing an upstanding fixed emplacement for use are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,512,759 to Resler discloses a fence wall construction. U.S. Pat. No. 3,537,687 to Adelman discloses a garden fence and wall. U.S. Pat. No. 3,604,685 to Pokryfkl discloses a fence and wall structure. U.S. Pat. No. 5,129,628 to Vesper discloses a fence panel and wall construction. U.S. Pat. No. 5,184,808 to Vesper discloses a fence wall construction.

While these devices fulfill their respective, particular objective and requirements, the aforementioned patents do not describe a retaining wall structure that is simple in design and can be readily assembled.

In this respect, the retaining wall structure according to the present invention substantially departs from the conventional concepts and designs of the prior art, and in doing so provides an apparatus primarily developed for the purpose of blocking a view or supporting weight placed thereagainst.

Therefore, it can be appreciated that there exists a continuing need for new and improved retaining wall structure which can be used for blocking a view or supporting weight placed thereagainst. In this regard, the present invention substantially fulfills this need.

SUMMARY OF THE INVENTION

In the view of the foregoing disadvantages inherent in the known types of walls now present in the prior art, the present invention provides an improved retaining wall structure. As such, the general purpose of the present invention, which will be described subsequently in greater detail, is to provide a new and improved retaining wall structure and method which has all the advantages of the prior art and none of the disadvantages.

To attain this, the present invention essentially comprises, in combination, a rigid rectangular base plate having a fixed thickness, a length of about 4 to 8 feet, and a height of about 2 to 4 feet. The base plate also has an outboard surface, an inboard surface, a periphery interconnecting the surfaces formed of a top edge, a bottom edge, and a pair of opposed side edges, a top slot formed along a central longitudinal extent of the top edge, a side slot formed along a central longitudinal extent of each side edge, a first set of eyelets extended outwards from the inboard surface near one side edge and with the eyelets of the first set aligned about a first common vertical axis of symmetry, and a second set of eyelets extended outwards from the inboard surface near the other side edge and with the eyelets of the second set aligned about a second common vertical axis of symmetry.

A pair of rigid rectangular end caps is included. Each end cap has a length equal to the height of the base plate and a width equal to the thickness of the base plate. Each end cap also has an inboard planar surface, an outboard planar surface, a periphery interconnecting the surfaces formed of a top edge, a bottom edge, and a pair of opposed side edges, and an elongated side protrusion extended from a central longitudinal extent of the inboard surface thereof. Each side protrusion of each end cap is snapidly secured within a separate side slot of the base plate. A rigid rectangular top cap is included and has a length equal to the length of the base plate and a width equal to the thickness of the base plate. The top cap also has an inboard surface, an outboard surface, a periphery interconnecting the surfaces formed of a pair of opposed long edges and a pair of opposed short side edges, and an elongated top protrusion extended from a central longitudinal extent of the inboard surface. The top protrusion is snapidly secured within the top slot of the base plate.

A pair of rigid elongated support braces is provided. Each support brace has a central linear portion interconnected between a pair of generally circular eyelets. Lastly, four elongated rigid spikes are included. Each spike has a head on one end and a point on the other end. One of the spikes is slidably disposed within the eyelets of the first set and one of the eyelets of one of the support braces to form a first hinged connection. Another spike is slidably disposed within the second set of eyelets of the base plate one of the eyelets of the other support brace to form a second hinged connection. The remaining spikes are each slidably disposed within one of the remaining eyelets of each support brace. The pointed ends of the spikes are securable in a recipient surface for holding the base plate in an upstanding configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved retaining wall structure which has all the advantages of the prior art walls and none of the disadvantages.

It is another object of the present invention to provide a new and improved retaining wall structure which may be easily and efficiently manufactured and marketed.

It is a further object of the present invention to provide a new and improved retaining wall structure which is of durable and reliable construction.

An even further object of the present invention is to provide a new and improved retaining wall structure which is susceptible of a low cost of manufacture with regard to both materials and labor, and which accordingly is then susceptible of low prices of sale to the consuming public, thereby making such a retaining wall structure economically available to the buying public.

Still yet another object of the present invention is to provide a new and improved retaining wall structure which provides in the apparatuses and methods of the prior art some of the advantages thereof, while simultaneously overcoming some of the disadvantages normally associated therewith.

Even still another object of the present invention is to provide a new and improved retaining wall structure for blocking a view or supporting weight placed thereagainst.

Lastly, it is an object of the present invention to provide a new and improved retaining wall structure comprising a rectangular base plate having an outboard surface, an inboard surface, a periphery interconnecting the surfaces formed of a top edge, a bottom edge, and a pair of opposed side edges, a top slot formed along the top edge, a side slot formed along each side edge, a first set of symmetrically aligned eyelets extended outwards from the inboard surface near one side edge, and a second set of symmetrically aligned eyelets extended outwards from the inboard surface near the other side edge; a pair of support braces with each support brace having a central portion interconnected between a pair of eyelets; and four spikes with one of the spikes slidably disposed within the eyelets of the first set and one of the eyelets of one of the support braces, another spike slidably disposed within the second set of eyelets of the base plate and one of the eyelets of the other support brace, and the remaining spikes each slidably disposed within one of the remaining eyelets of each support brace and with the spikes securable in a recipient surface for holding the base plate in an upstanding configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

With reference now to the drawings, the preferred embodiment of the new and improved retaining wall structure embodying the principles and concepts of the present invention and generally designated by the reference number 10 will be described.

The present invention is comprised of a plurality of components. In their broadest context, such components include a base plate, caps, braces, and spikes. Such components are individually configured and correlated with respect to each other to provide the intended function of blocking a view or supporting weight placed thereagainst.

Figure 1:
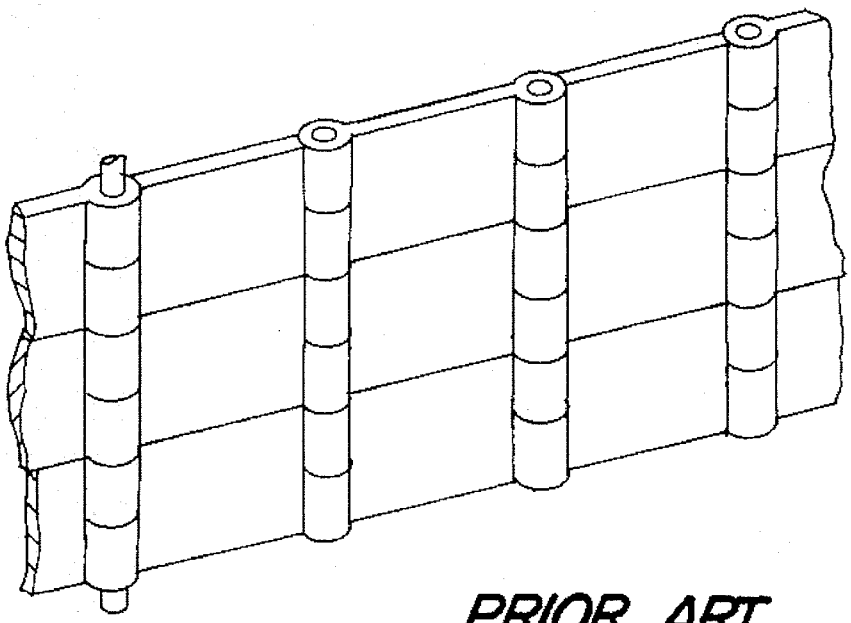
FIG. 1 is a perspective view of a prior art garden fence and wall.
Figure 2:
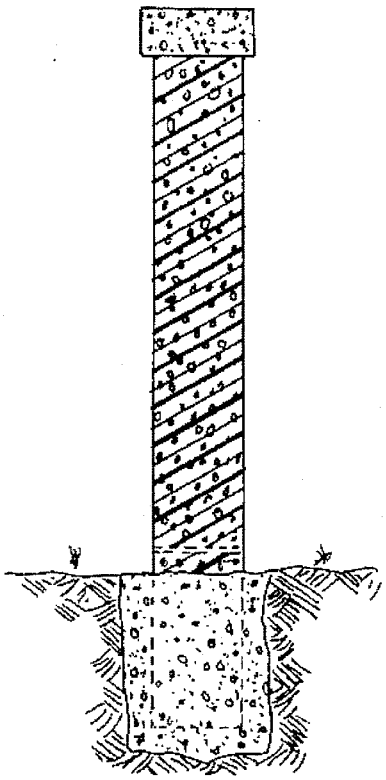
PRIOR ART Fig. 2
FIG. 2 is a cross-sectional view of a prior art fence and wall construction.
Figure 3:
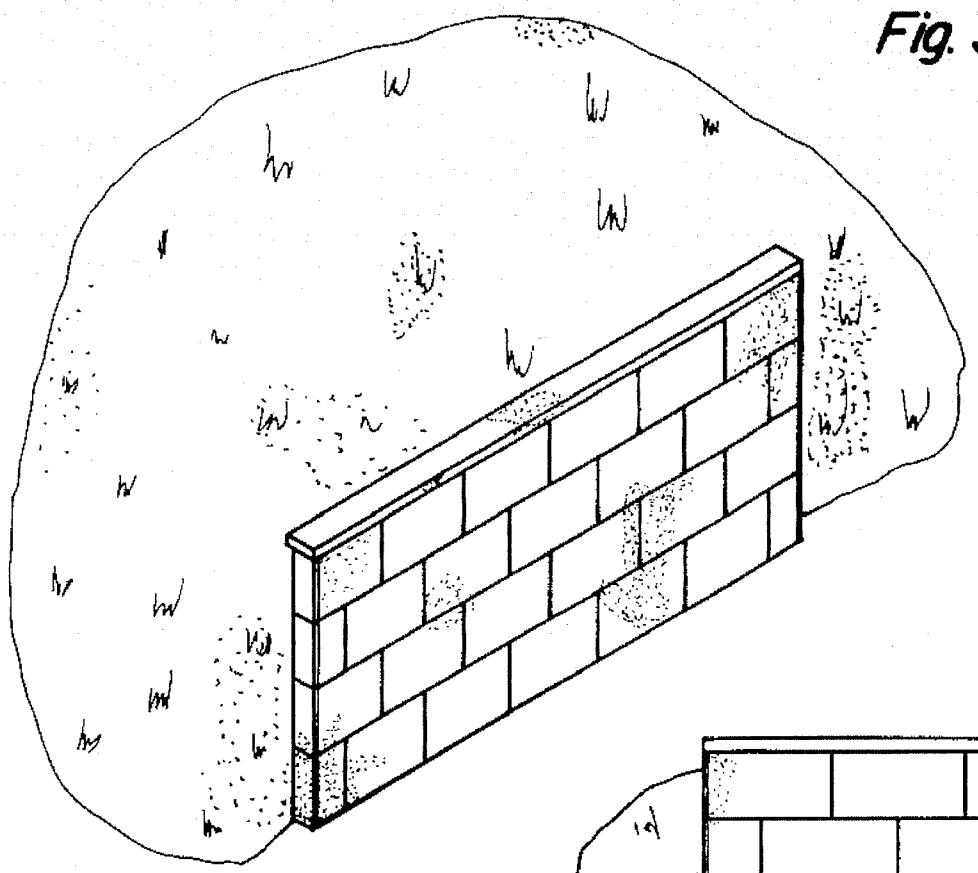
FIG. 3 is a perspective view of the preferred embodiment constructed in accordance with the principles of the present invention in a retaining configuration.
Figure 4:
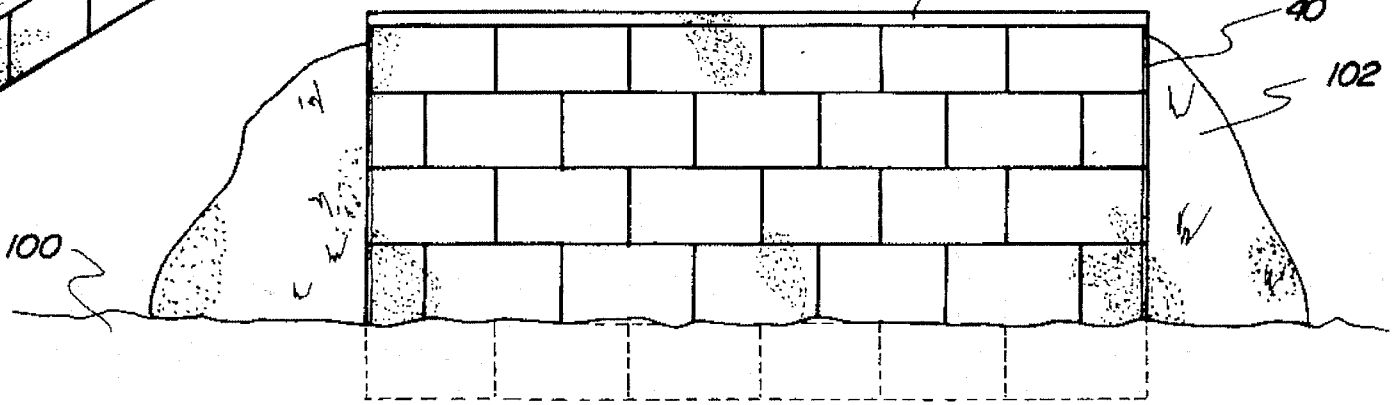
FIG. 4 is a side-elevational view of the present invention and further depicting a portion thereof embedded into a recipient surface such as earth.
Figure 5:
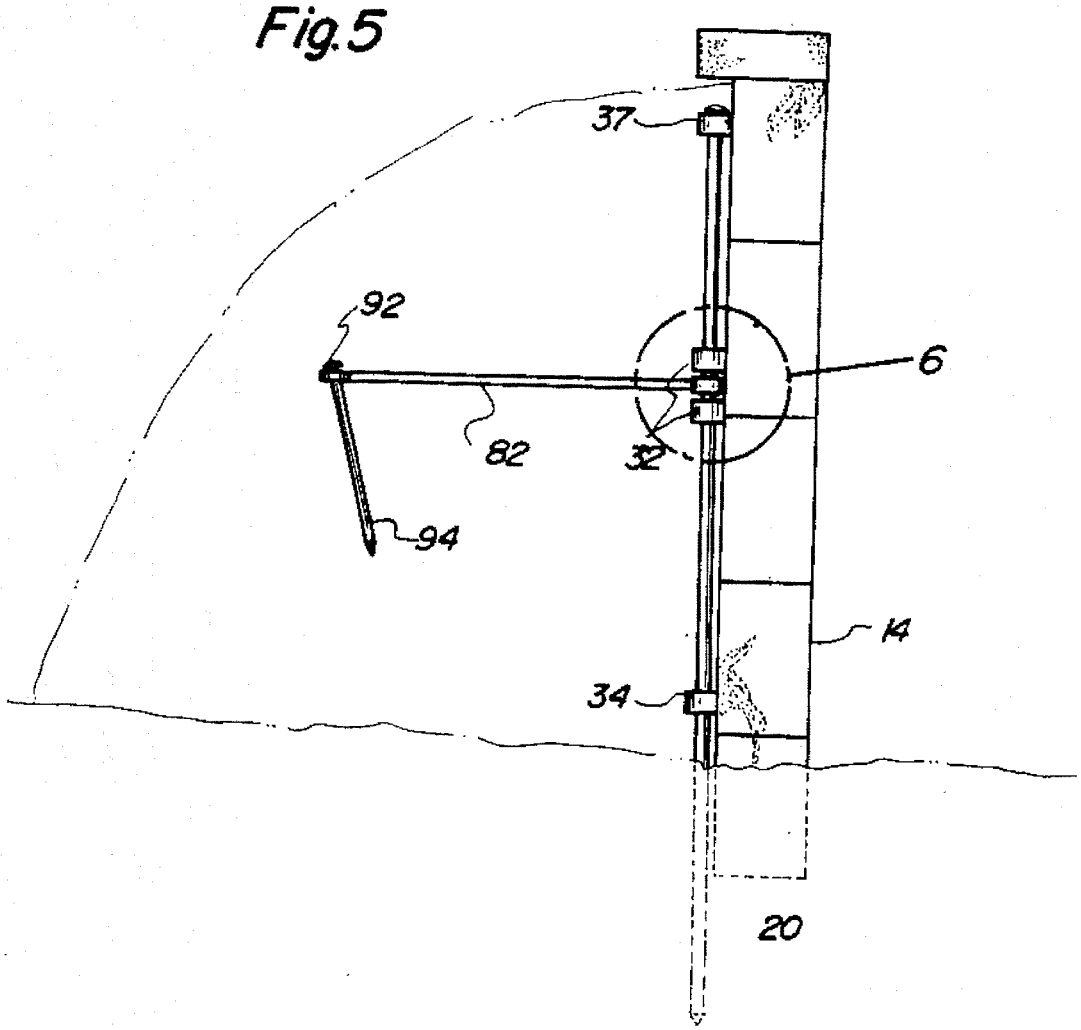
FIG. 5 is a side-elevational view of the present invention.
Figure 8:
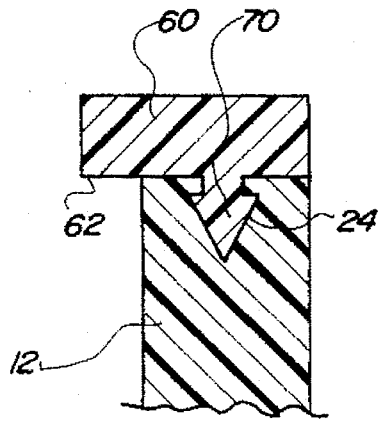
FIG. 8 is a cross-sectional view of the coupling of the top cap with the base plate. Similar coupling is performed with a side cap and the base plate.

Specifically, the present invention includes a base plate 12. The base plate is rectangular in structure and formed of a rigid material such as plastic. The base plate has a fixed thickness, a length of about 4 to 8 feet, and a height of about 2 to 4 feet. The base plate also has an outboard and generally planar surface 14, an inboard and generally planar surface 16, and a periphery interconnecting the surfaces. Indicia can be disposed on the surfaces 14, 16 to enhance their appearance. The periphery of the base plate is formed of a planar top edge 18, a planar bottom edge 20, and a pair of planar opposed side edges 22 extended therebetween. A top slot 24 is formed along a central longitudinal extent of the top edge. The top slot has a generally arrow-shaped vertical cross-section and a generally rectangular opening. As best illustrated in FIG. 8, the slot is bounded by a pair of angled and connected lower surfaces, a pair of parallel spaced upper surfaces, and a pair of spaced horizontal intermediate surfaces interconnecting the upper surfaces and lower surfaces. A side slot 26 is formed along a central extent of each side edge 22. Each side slot has a rectangular opening and the shape cross sectional shape as the top slot. The base plate additionally includes a first set 28 of generally semicircular eyelets. The first set of eyelets is connected to and extended outwards from the inboard surface 16 near one of the side edges 22. The eyelets of the first set are aligned about a common vertical axis of symmetry. A second set 30 of semicircular eyelets is also included. The second set of eyelets is connected to and extended outwards from the inboard surface near the other side edge. The eyelets of the second set are aligned about a second common vertical axis of symmetry. In the preferred embodiment, each set includes four eyelets that are positioned to thereby form an inner pair 32 and an outer pair 34 as shown in FIG. 5.

A pair of end caps 40 are included. The end caps are formed of a rigid material such as plastic. Each end cap is rectangular in structure. Each end cap has a length equal to the height of the base plate and a width equal to the thickness of the base plate. The thickness of each end cap is much less than its height or width. Each end cap further includes an inboard and generally planar surface 42, an outboard and generally planar surface 44, and a periphery interconnecting the surfaces. Indica can be placed on the end caps to enhance their appearance. The periphery of each end cap is formed of a planar top edge 46, a planar bottom edge 48, and a pair of opposed planar side edges 50 extended therebetween. In addition, each end cap includes an elongated side protrusion 52 extended from a central longitudinal extent of the inboard surface. Each side protrusion has an arrow-shaped cross-section that is sized to essentially conform with the cross-sectional extent of a side slot 26. Each end cap is snapidly secured within a separate side slot of the base plate.

In addition, a top cap 60 is included. The top cap is rectangular in structure and formed of a rigid material such as plastic. The top cap has a length equal to the length of the base plate and a width equal to the thickness of the base plate. The thickness of the top cap is much less than its height or width. The top cap further includes an inboard and generally planar surface 62, an outboard and generally planar surface 64, and a periphery interconnecting the surfaces. Indica can be placed on the top cap to enhance its appearance. The periphery of the top cap is formed of a pair of opposed long edges 66 and a pair of opposed short side edges 68. In addition, an elongated top protrusion 70 extends from a central longitudinal extent of the inboard surface. The top protrusion has an arrow-shaped cross-section that is sized to essentially conform with the top slot 24 as shown in FIG. 8. The top protrusion is snapidly secured within the top slot 24 of the base plate. When snapidly secured to the top edge and side edges of the base plate, the caps 40, 60 provide a finished look to the present invention.

A pair of support braces 80 are provided. Each support brace is elongated in structure and formed of a rigid material such as plastic. Each support brace has a central linear portion 82. This linear portion is interconnected between a pair of generally circular eyelets 84.

Figure 6:
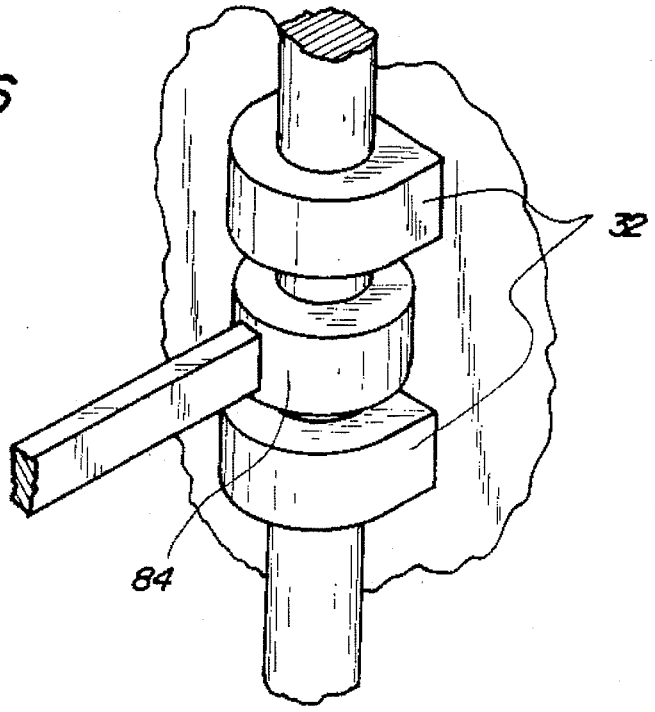
FIG. 6 is an enlarged perspective fragmentary view of the coupling of a support brace with the base plate through use of a spike.
Figure 7:
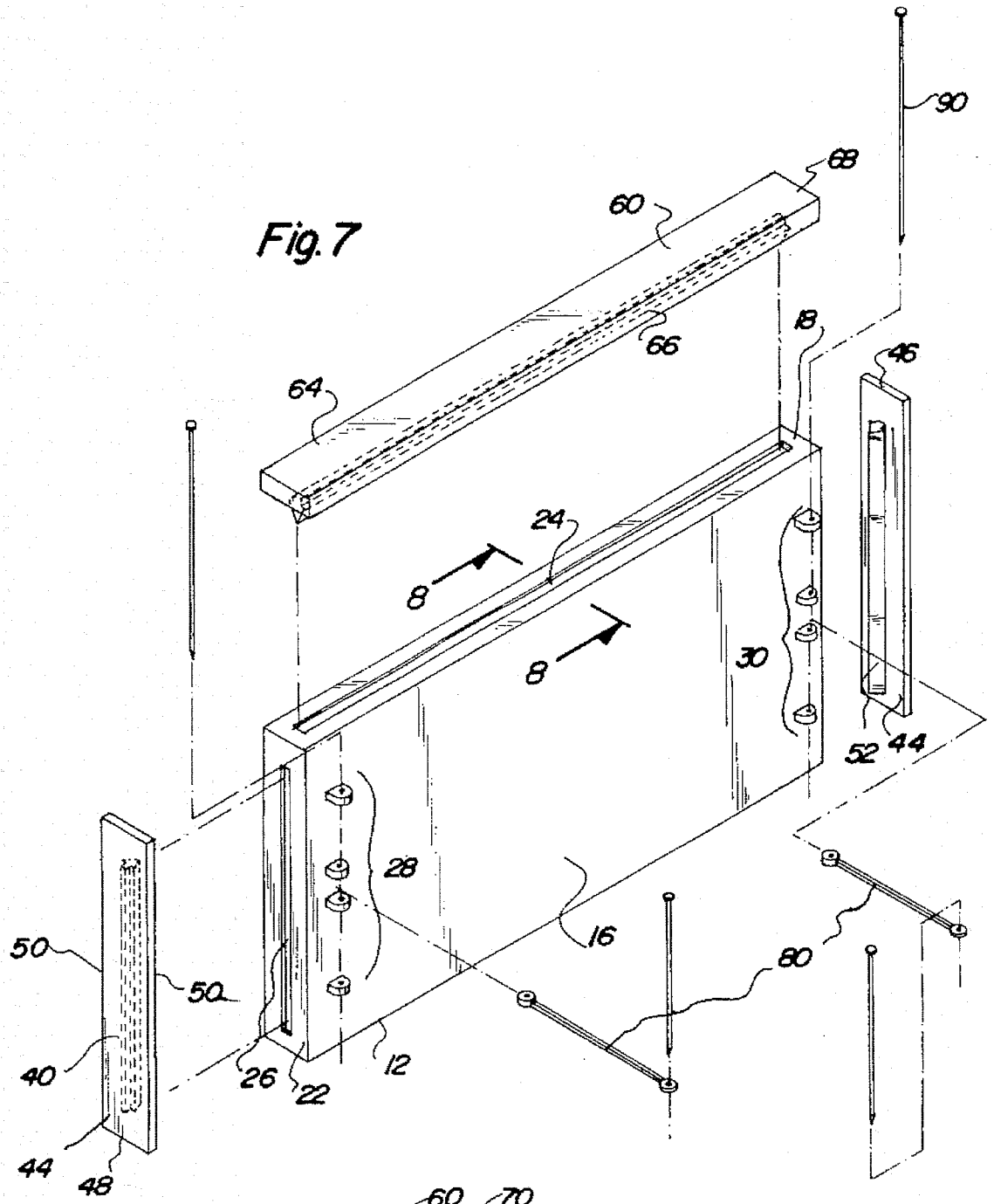
FIG. 7 is an exploded perspective view of the present invention.

Lastly, four spikes 90 are provided. Each spike is elongated in structure and formed of a rigid material such as plastic or metal. Each spike has a head 92 on one end and a point 94 on the other end. As best illustrated in FIG. 7, one of the spikes is slidably disposed within the eyelets of the first set 28 and one of the eyelets 84 of the support braces 80 to form a first hinged connection. Preferably, as shown in FIGS. 5 and 6, the eyelet 84 is positioned between the inner pair 32 of eyelets of the base plate. Another spike is slidably disposed within the second set 70 of eyelets of the base plate and one of the eyelets 84 of the other support brace to form a second hinged connection. The remaining spikes are each slidably disposed within one of the remaining eyelets of each support brace 80. The support braces are then positioned outwards from the base plate. The pointed ends of the spikes are securable in a recipient surface such as the earth 100. In this secured configuration, the base plate is held in an upstanding configuration for providing a decorative effect, blocking a view, or supporting weight such as ground 102 placed thereagainst. In addition, multiple embodiments of the present invention can be placed in an end-to-end configuration for enclosing a space.

The present invention is a prefabricated retaining wall which is less expensive and much easier to place in operation than conventional landscaping walls. The present invention is formed of prefabricated molded plastic components. The base plate of the present invention ranges in size from 2 to 4 feet in height to 4 to 8 feet in length. The base plate and caps can vary in appearance from natural wood to stone, brick, or slate. The end caps are positioned within the slots on the base plate to give the wall a finished look. The spikes are used in conjunction with the support rods for holding the present invention in an upstanding configuration once sunk into an original grade. Each spike of the present invention has a length of at least 24 inches long.

To install the present invention, first dig a shallow trench measuring 2 inches wide by about 3 inches deep. Next, place a lower extent of the base plate of the present invention within this trench such that its bottom edge is placed in contact with an external supporting surface. Install the spikes and drive them into the ground to a depth of about 24 inches. Anchor the base plate of the present invention using the support braces and spikes at the prescribed intervals. Lastly, cap the top and sides and then backfill the base plate. The present invention can easily be installed by one person in a short time. It enables a user to add a visual effect as well as different textures to a landscape. The present invention is ideal for setting off a perennial border or an accent planting.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A retaining wall structure for blocking a view or supporting weight placed thereagainst comprising, in combination:

a rigid rectangular base plate having a fixed thickness, a length of about 4 to 8 feet, a height of about 2 to 4 feet, an outboard planar surface, an inboard planar surface, a periphery interconnecting the surfaces formed of a top edge, a bottom edge, and a pair of opposed side edges, a top slot formed along a central longitudinal extent of the top edge, a side slot formed along a central longitudinal extent of each side edge, a first set of eyelets extended outwards from the inboard surface near one side edge and with the eyelets of the first set aligned about a first common vertical axis of symmetry, and a second set of eyelets extended outwards from the inboard surface near the other side edge and with the eyelets of the second set aligned about a second common vertical axis of symmetry;

a pair of rigid rectangular end caps, each end cap having a length equal to the height of the base plate and a width equal to the thickness of the base plate, each end cap further having an inboard planar surface, an outboard planar surface, a periphery interconnecting the surfaces formed of a top edge, a bottom edge, and a pair of opposed side edges, and an elongated side protrusion extended from a central longitudinal extent of the inboard surface thereof and with each side protrusion of each end cap snapidly secured within a separate side slot of the base plate;

a rigid rectangular top cap having a length equal to the length of the base plate and a width equal to the thickness of the base plate, the top cap further having an inboard surface, an outboard surface, a periphery interconnecting the surfaces formed of a pair of opposed long edges and a pair of opposed short side edges, and an elongated top protrusion extended from a central longitudinal extent of the inboard surface and with the top protrusion snapidly secured within the top slot of the base plate;

a pair of rigid elongated support braces, each support brace having a central linear portion interconnected between a pair of generally circular eyelets; and four elongated rigid spikes, each spike having a head on one end and a point on the other end with one of the spikes slidably disposed within the eyelets of the first set and one of the eyelets of one of the support braces to form a first hinged connection, another spike slidably disposed within the second set of eyelets of the base plate one of the eyelets of the other support brace to form a second hinged connection, and the remaining spikes each slidably disposed within one of the remaining eyelets of each support brace and with the pointed ends of the spikes securable in a recipient surface for holding the base plate in an upstanding configuration.

2. A retaining wall structure comprising:

a rectangular base plate having an outboard surface, an inboard surface, a periphery interconnecting the surfaces formed of a top edge, a bottom edge, and a pair of opposed side edges, a top slot formed along the top edge, a side slot formed along each side edge, a first set of symmetrically aligned eyelets extended outwards from the inboard surface near one side edge, and a second set of symmetrically aligned eyelets extended outwards from the inboard surface near the other side edge;

a pair of support braces with each support brace having a central portion interconnected between a pair of eyelets; and four spikes with one of the spikes slidably disposed within the eyelets of the first set and one of the eyelets of one of the support braces, another spike slidably disposed within the second set of eyelets of the base plate and one of the eyelets of the other support brace, and the remaining spikes each slidably disposed within one of the remaining eyelets of each support brace and with the spikes securable in a recipient surface for holding the base plate in an upstanding configuration.

3. The retaining wall structure as set forth in claim 2 wherein the base plate has a fixed thickness.

4. The retaining wall structure as set forth in claim 2 wherein the base plate has a length of about 4 to 8 feet.

5. The retaining wall structure as set forth in claim 2 wherein the base plate has a height of about 2 to 4 feet.

6. The retaining wall structure as set forth in claim 2 and further comprising a pair of end caps with each cap snapidly secured within a separate side slot of the base plate to thereby cover the associated side edge.

7. The retaining wall structure as set forth in claim 2 and further comprising a top cap snapidly secured within the top slot of the base plate to thereby cover the associated top edge.

* * * * *